US007404627B1

(12) United States Patent
Gao et al.

(10) Patent No.: US 7,404,627 B1
(45) Date of Patent: Jul. 29, 2008

(54) ENERGY DAMPING FLOW DEVICE FOR PRINTING SYSTEM

(75) Inventors: Zhanjun Gao, Rochester, NY (US); Jinquan Xu, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/770,774

(22) Filed: Jun. 29, 2007

(51) Int. Cl.
*B41J 2/09* (2006.01)

(52) U.S. Cl. ..... 347/77

(58) Field of Classification Search ..... 347/77, 347/82, 83, 73
See application file for complete search history.

(56) References Cited

U.S. PATENT DOCUMENTS 4,068,241 A 1/1978 Yamada
4,245,226 A * 1/1981 Paranjpe et al. ..... 347/77
4,356,500 A * 10/1982 Graf ..... 347/77
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.

* cited by examiner

*Primary Examiner*—K. Feggins
(74) *Attorney, Agent, or Firm*—William R. Zimmerli

(57) ABSTRACT

A printing system includes a liquid drop ejector that is operable to eject liquid drops having a plurality of volumes along a first path. A fluid passage includes an energy damping structure. A fluid flow source is operable to cause the fluid to flow through the passage along the energy damping structure. Interaction of the fluid flow and the liquid drops causes liquid drops having one of the plurality of volumes to begin moving along a second path.

17 Claims, 6 Drawing Sheets

ENERGY DAMPING FLOW DEVICE FOR PRINTING SYSTEM

CROSS REFERENCE TO RELATED APPLICATIONS

Reference is made to commonly-assigned, U.S. patent application Ser. No. 11/770,786, filed currently herewith, entitled "ACOUSTIC FLUID FLOW DEVICE FOR PRINTING SYSTEM," and U.S. patent application Ser. No. 11/770,804, filed currently herewith, entitled "PERFORATED FLUID FLOW DEVICE FOR PRINTING SYSTEM."

FIELD OF THE INVENTION

This invention relates generally to the management of fluid flow and, in particular to the management of fluid flow in printing systems.

BACKGROUND OF THE INVENTION

Printing systems that deflect drops using a gas flow are known, see, for example, U.S. Pat. No. 4,068,241, issued to Yamada, on Jan. 10, 1978.

The device that provides gas flow to the gas flow drop interaction area can introduce turbulence in the gas flow that may augment and ultimately interfere with accurate drop deflection or divergence. Turbulent flow introduced from the gas supply typically increases or grows as the gas flow moves through the structure or plenum used to carry the gas flow to the gas flow drop interaction area of the printing system.

Drop deflection or divergence can be affected when turbulence, the randomly fluctuating motion of a fluid, is present in, for example, the interaction area of the drops (traveling along a path) and the gas flow force. The effect of turbulence on the drops can vary depending on the size of the drops. For example, when relatively small volume drops are caused to deflect or diverge from the path by the gas flow force, turbulence can randomly disorient small volume drops resulting in reduced drop deflection or divergence accuracy which, in turn, can lead to reduced drop placement accuracy.

Accordingly, a need exists to reduce turbulent gas flow in the gas flow drop interaction area of a printing system.

SUMMARY OF THE INVENTION

According to one aspect of the invention, a printing system includes a liquid drop ejector that is operable to eject liquid drops having a plurality of volumes along a first path. A fluid passage includes an energy damping structure. A fluid flow source is operable to cause the fluid to flow through the passage along the energy damping structure. Interaction of the fluid flow and the liquid drops causes liquid drops having one of the plurality of volumes to begin moving along a second path.

According to another aspect of the invention, a method of printing includes providing liquid drops having a plurality of volumes traveling along a first path; providing a fluid passage including an energy damping structure; and causing a fluid to flow through the passage along the energy damping structure, wherein interaction of the fluid flow and the liquid drops causes liquid drops having one of the plurality of volumes to begin moving along a second path.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
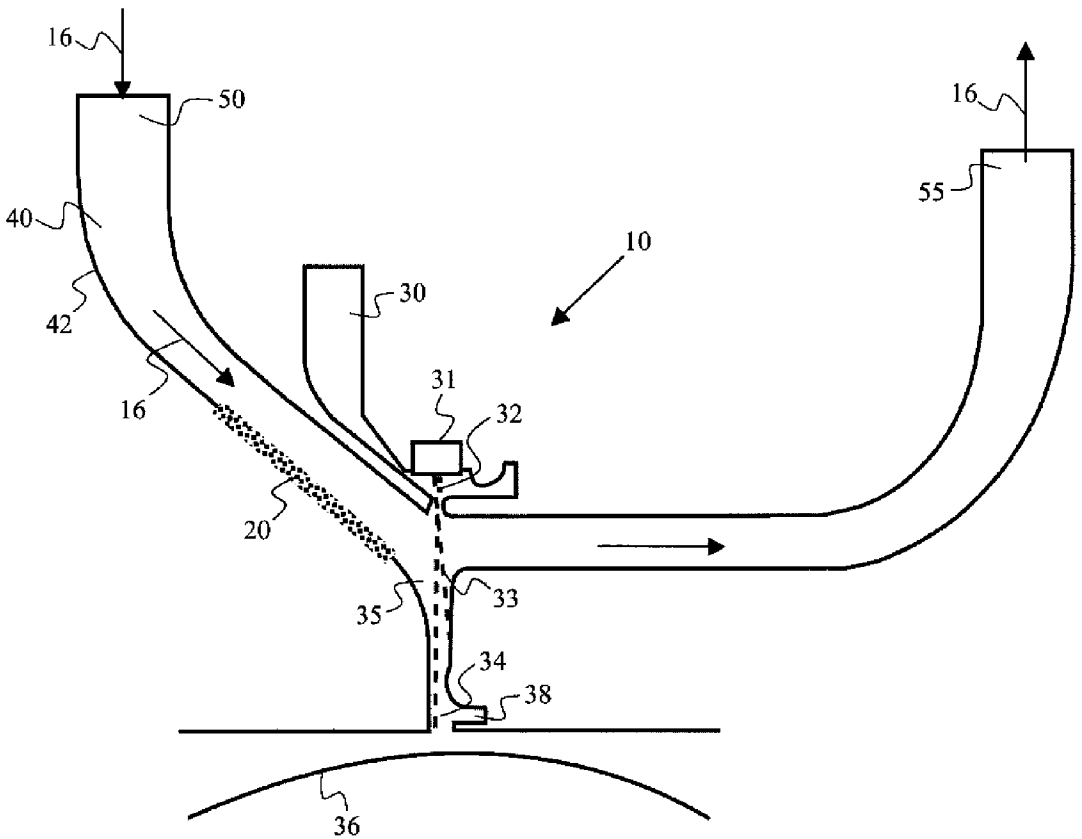
FIG. 1 is a schematic side view of a printing system incorporating an example embodiment of an energy damping structure of the present invention.

The present description will be directed in particular to elements forming part of, or cooperating more directly with, apparatus in accordance with the present invention. It is to be understood that elements not specifically shown or described may take various forms well known to those skilled in the art.

The example embodiments of the present invention are illustrated schematically and not to scale for the sake of clarity. One of ordinary skill in the art will be able to readily determine the specific size and interconnections of the elements of the example embodiments of the present invention. In the following description, identical reference numerals have been used, where possible, to designate identical elements.

Although the term printing system is used herein, it is recognized that printing systems are being used today to eject other types of liquids and not just ink. For example, the ejection of various fluids such as medicines, inks, pigments, dyes, and other materials is possible today using printing systems. As such, the term printing system is not intended to be limited to just systems that eject ink.

Referring to FIG. 1, a schematic view of a printing system 10 incorporating an acoustic energy source 20 is shown. Printing system 10 includes a liquid drop ejector or printhead 30 positioned to eject drops 32 through passage 35. At least some the drops 32 contact a receiver 36 while other drops are collected by a catcher 38.

A fluid flow 16 is provided through fluid passage 40 with wall 42. Energy damping structure 20 is attached to wall 42. Printhead 30 includes a drop forming mechanism 31 operable to form drops 32 having a plurality of volumes traveling along a first path. The fluid flow 16 is applied in a direction such that drops having one of the plurality of volumes diverge (or deflect) from the first path (not shown in FIG. 1) and begin traveling along a second path 33 while drops having another of the plurality of volumes remain traveling substantially along the first path or diverge (deflect) slightly and begin traveling along a third path 34. Receiver 36 is positioned along one of the first, second, and third paths while catcher 38 is positioned along another of the first, second and third paths depending on the specific application contemplated. Printheads like printhead 30 are known and have been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; and U.S. Pat. No. 6,588,888 B2, issued to Jeanmaire et al., on Jul. 8, 2003.

After being ejected by the drop forming mechanism of printhead 30, drops 32 travel along the first path which is substantially perpendicular to printhead 30. Energy damping structure 20 is attached to wall 42 of the passage 40 of the fluid flow 16. The fluid flow source 16 is operatively associated with one or both of the inlet portion 50 and the outlet portion 55. For example, pressurized gas (e.g. air) from a pump can be introduced in the inlet portion 50 and/or a vacuum (negative air pressure relative to ambient operating conditions) from a vacuum pump can be introduced in the outlet portion 55. When fluid flow sources like these are introduced on the inlet portion 50 and the outlet portion 55 a sink for the fluid or gas flow is provided. The fluid or gas flow (represented by arrows 16) of the drop deflector interacts with ejected drops 32 and causes drops 32 to diverge or deflect as described above. The amount of deflection is volume dependent with smaller volume drops being deflected by the fluid or gas flow more than larger volume drops. The energy damping structure 20 attached to wall 42 provides damping effect to the turbulence. In other words, the energy damping structure 20 absorbs the disturbance energy and leads to laminar-turbulent transition delay.

The design of energy damping structure is dependent upon a number of variable factors including the rate of fluid flow, passage size, etc. Specifically, the effectiveness of the energy damping structure relates directly to its impedance and transmission coefficient. The impedance (Z) of the energy damping structure is defined as the product of its density (p) and flow velocity (v).

$$Z=pV \tag{1}$$

Impedance is important in the determination of transmission and reflection at the boundary of two media having different acoustic impedances. The values of the reflected and transmitted energy are the fractional amounts of the total energy incident on the interface. Note that the fractional amount of transmitted energy plus the fractional amount of reflected energy equals one.

Waves are reflected at boundaries where there is a difference in impedances (Z) of the media on each side of the boundary. This difference in Z is commonly referred to as the impedance mismatch. The greater the impedance mismatch, the greater the percentage of energy that will be reflected at the interface or boundary between one medium and another.

The fraction of the incident wave intensity that is refracted can be derived because particle velocity and local particle pressures must be continuous across the boundary. When the acoustic impedances of the materials on both sides of the boundary are known, the fraction of the incident wave intensity that is reflected can be calculated with the equation below. The value produced is known as the reflection coefficient. Multiplying the reflection coefficient by 100 yields the amount of energy reflected as a percentage of the original energy.

$$R=\left(\frac{Z_2-Z_1}{Z_2+Z_1}\right)^2 \tag{2}$$

Since the amount of reflected energy plus the transmitted energy must equal the total amount of incident energy, the transmission coefficient is calculated by simply subtracting the reflection coefficient from one.

$$T=1-R=1-\left(\frac{Z_2-Z_1}{Z_2+Z_1}\right)^2 \tag{3}$$

For example, the energy reflected at a water-stainless steel interface is 0.88 or 88%. The amount of energy transmitted into the second material is 0.12 or 12%.

Figure 2:
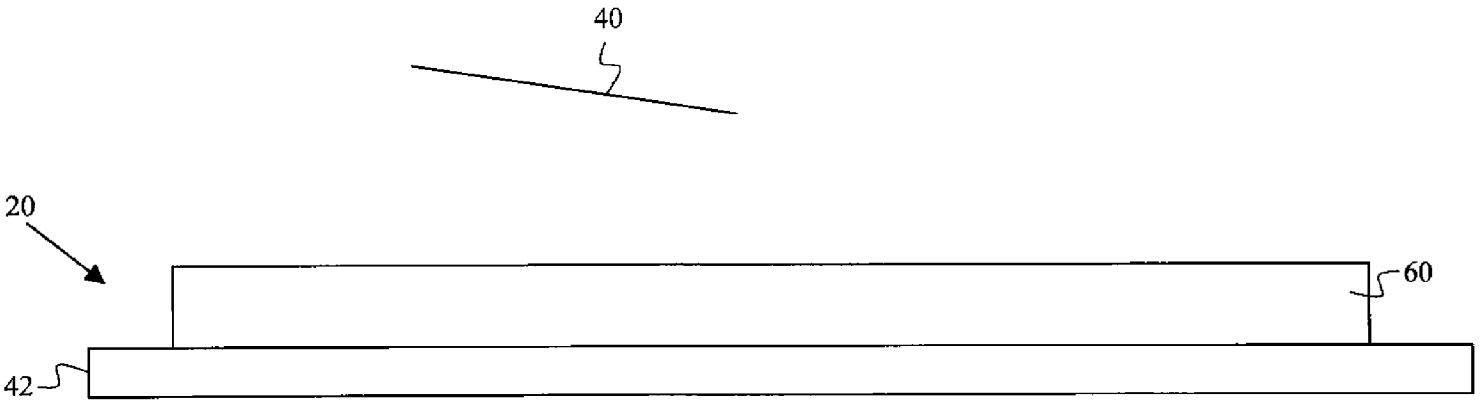
FIG. 2 is a schematic side view of an example embodiment of an energy damping structure with an energy damping coating or material.

An example embodiment of wall 42 of first passage 40 and energy damping structure 20 is shown in FIG. 2. In this embodiment, wall 42 includes an energy damping material 60 as part of the energy damping structure 20. The energy damping material 60 has a high transmission coefficient at the frequency of the disturbance wave that allows the absorption of the disturbance energy. The energy damping material 60 may be obtained as a thin coating on top of wall 42. The energy damping material 60 may also be obtained as a separate material bonded onto wall 42. Equations (2) and (3) offer a basis to select the energy damping material 60. The reflection coefficient R should be minimized and transmission coefficient T should be maximized so that most of disturbance energy is absorbed.

Figure 3:
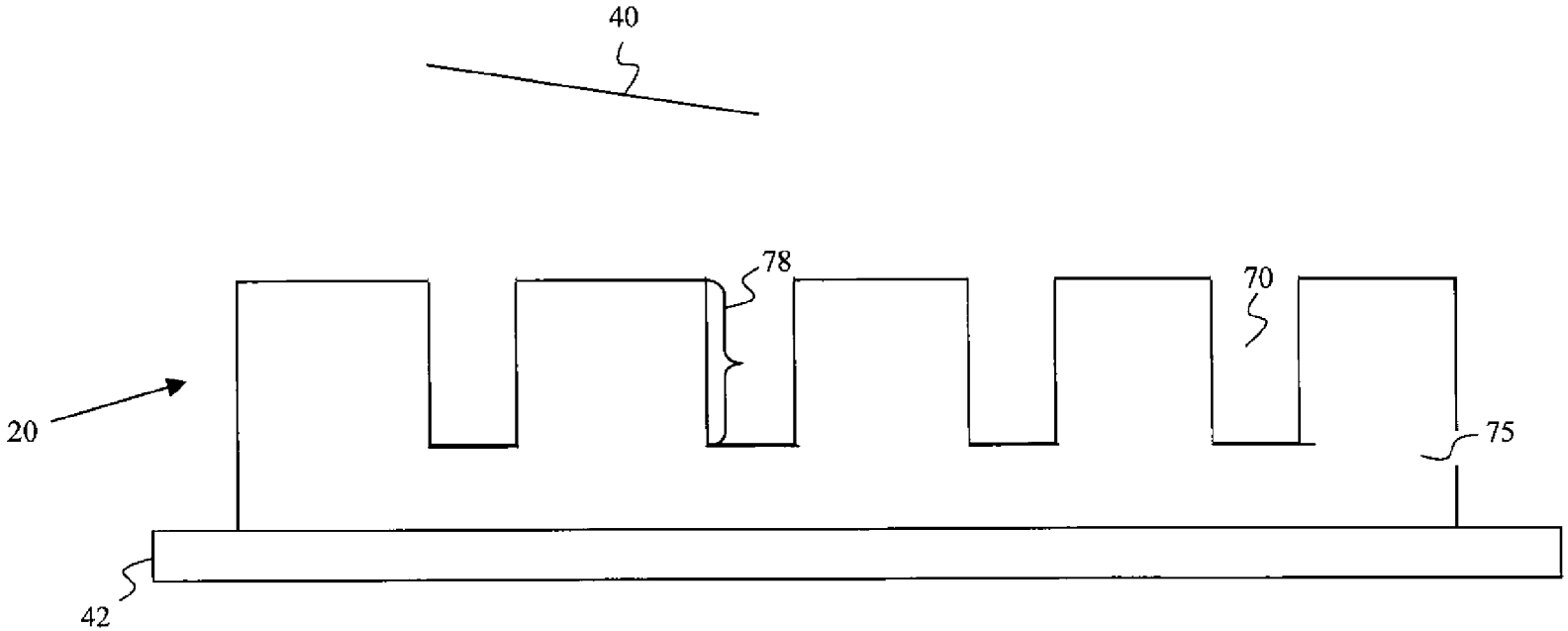
FIG. 3 is a schematic side view of an example embodiment of an energy damping structure with pores.

Another example embodiment of wall 42 of passage 40 and energy damping structure 20 is shown in FIG. 3. In this embodiment, wall 42 includes a material 75 and pores 70. The depth 78 of pores 70 does not cover the whole thickness of material 75.

Figure 4:
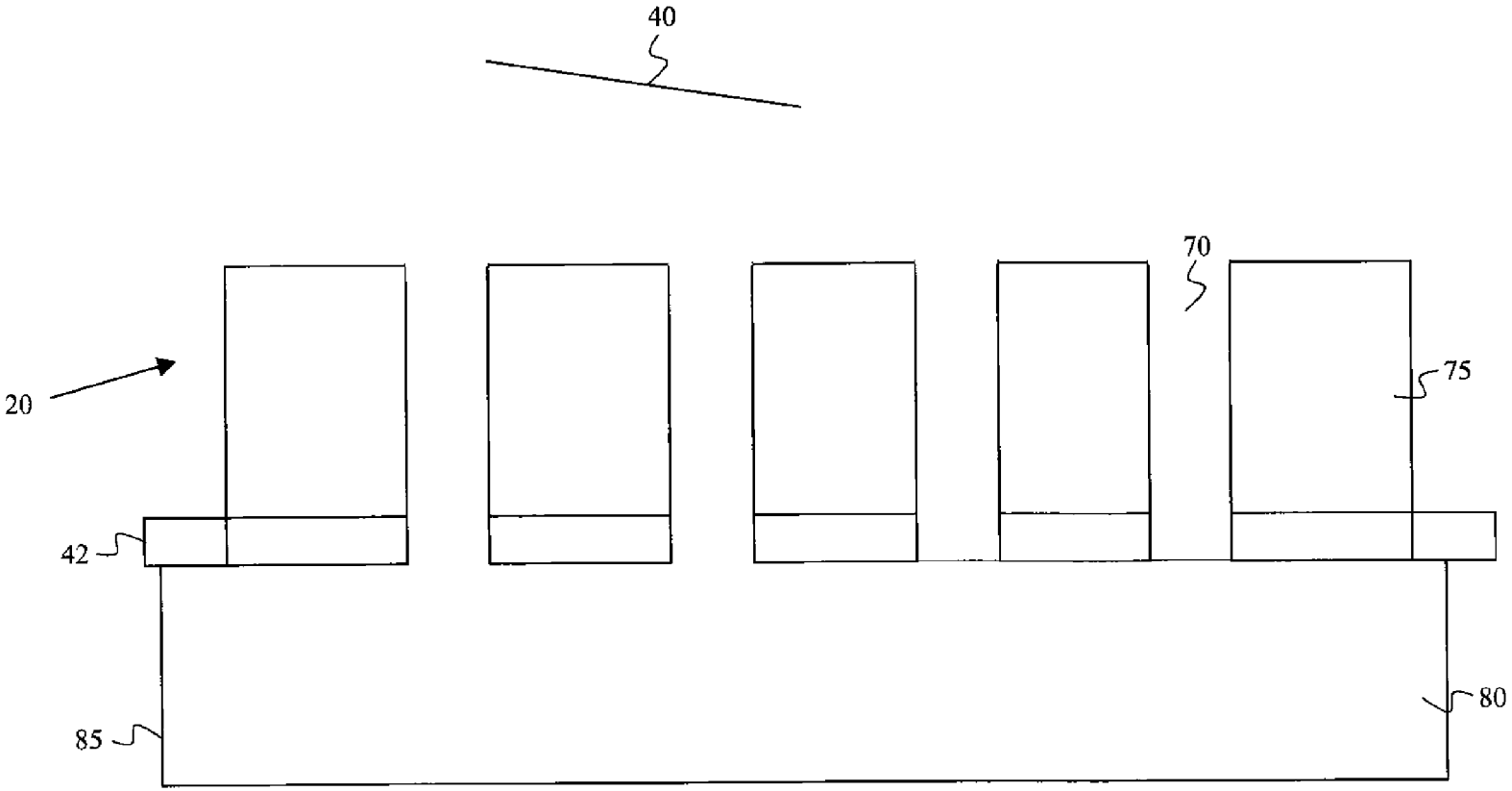
FIG. 4 is a schematic side view of an example embodiment of an energy damping structure with pores that form open fluid flow channels.

Another example embodiment of wall 42 of passage 40 and energy damping structure 20 is shown in FIG. 4. In this embodiment, wall 42 includes a material 75 and pores 70. The depth 78 of pores 70 covers the whole thickness of material 75, as well as wall 42. Therefore, the energy damping structure 20 contains through pores (holes), that allows fluid in passage 40 to flow through wall 42. In addition, the energy damping structure 20 includes a secondary wall 85 with a space 80. In the implementation of this embodiment, passage 40 may have a higher pressure than that in the space 80 so that a small portion of secondary fluid flow will pass through pores 70 into space 80. In another situation, passage 40 may have a lower pressure than that in the space 80 so that a small portion of secondary fluid flow will pass through pores 70 into passage 40.

Figure 5:
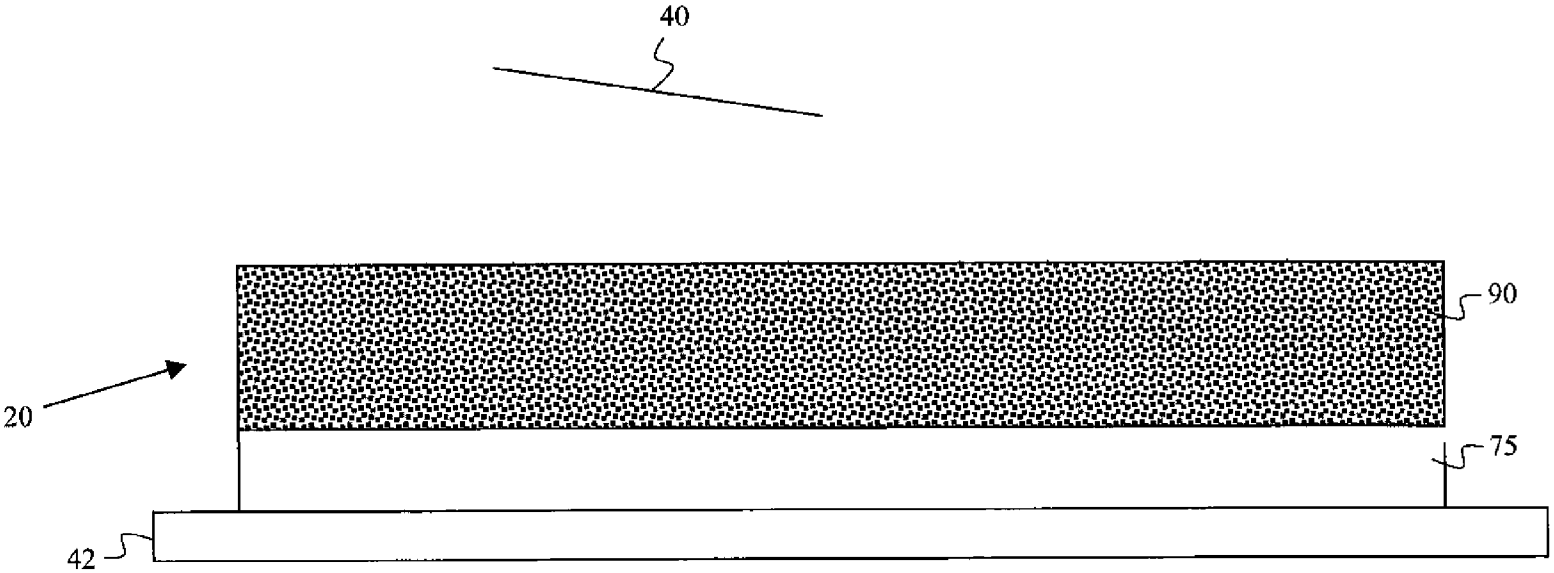
FIG. 5 is a schematic side view of an example embodiment of an energy damping structure with porous material.

Yet another example embodiment of wall 42 of passage 40 and energy damping structure 20 is shown in FIG. 5. In this embodiment, wall 42 includes a material 75 and a porous material 90. According to this embodiment of the present invention, the porous material 90 may be formed from various types of material including, but not limited to, polymer foam made from alkenyl aromatic resins, such as polystyrenic resin(s), and polyesters such as polyethylene terephthalates. The term "alkenyl aromatic polymer" includes polymers of aromatic hydrocarbon molecules that contain an aryl group joined to an olefinic group with only double bonds in the linear structure. The polymeric foam may also be made from polyolefinic resins such as LDPEs, HDPEs, LLDPEs, and the like. The polymeric foam is preferably made from a polystyrenic resin(s), such as a general purpose polystyrene, because of economical considerations at the present time. The polymeric foam, however, may be made from other polystyrenic resins such as impact polystyrenes. The impact polystyrenes that are generally used include medium impact polystyrenes and high impact polystyrenes. The polymeric foam may also be made from a combination of virgin and/or reprocessed material.

Figure 6:
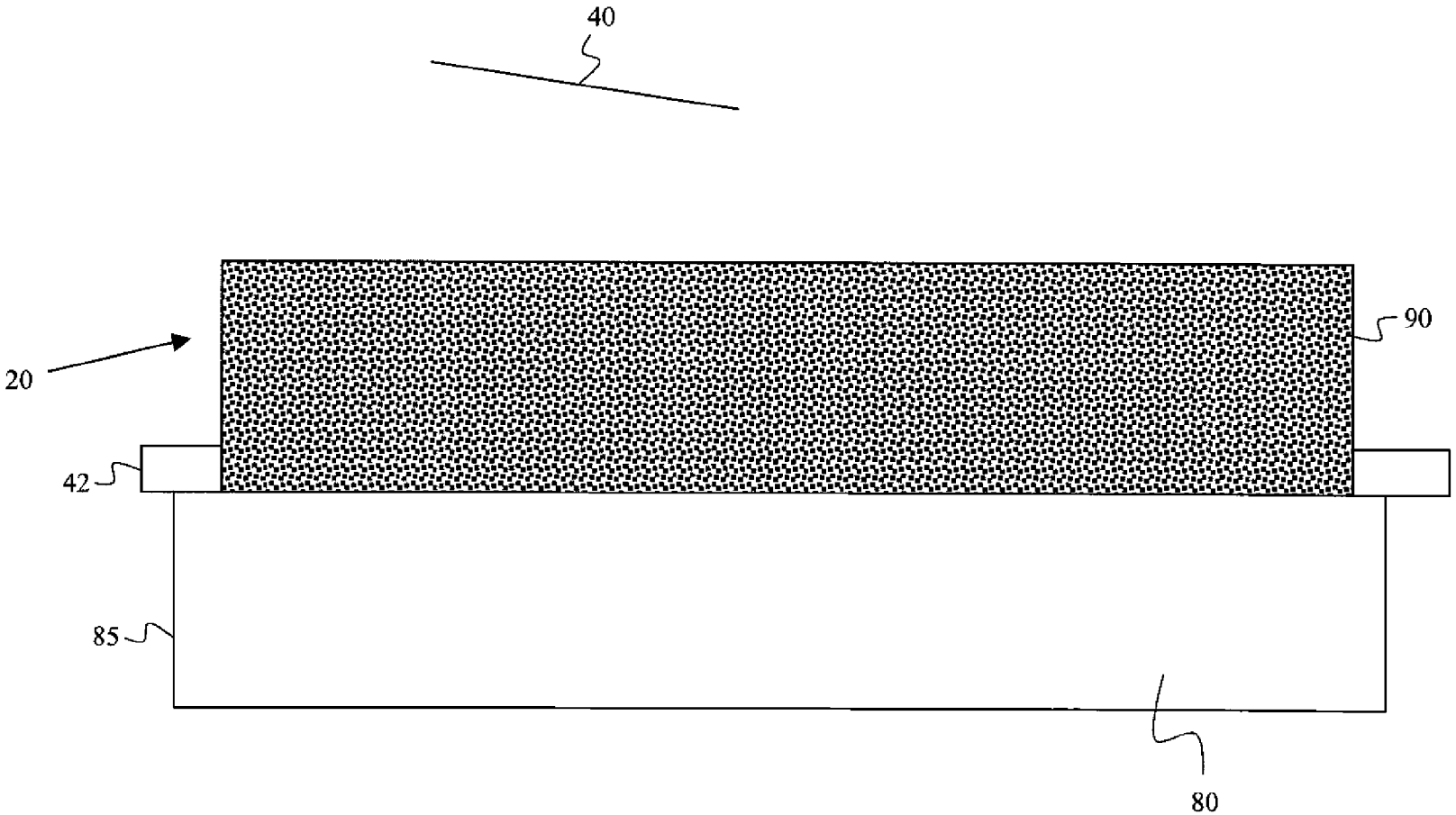
FIG. 6 is a schematic side view of an example embodiment of an energy damping structure with porous material that forms open fluid flow channels.

Another example embodiment of wall 42 of passage 40 and energy damping structure 20 is shown in FIG. 6. In this embodiment, wall 42 includes a material 90 that forms open fluid flow channels between passage 40 and space 80. In the implementation of this embodiment, passage 40 may have a higher pressure than that in the space 80 so that a small portion of secondary fluid flow will pass through pores 70 into space 80. In another situation, passage 40 may have a lower pressure than that in the space 80 so that a small portion of secondary fluid flow will pass through pores 70 into passage 40.

The invention has been described in detail with particular reference to certain example embodiments thereof, but it will be understood that variations and modifications can be effected within the scope of the invention.

PARTS LIST

| PARTS LIST | |
|---|---|
| 2 | equations |
| 3 | equations |
| 10 | printing system |
| 16 | fluid flow |
| 16 | arrows |
| 20 | acoustic energy source |
| 20 | energy damping structure |
| 30 | printhead |
| 31 | drop forming mechanism |
| 32 | drops |
| 33 | second path |
| 34 | third path |
| 35 | passage |
| 36 | receiver |
| 38 | catcher |
| 40 | passage |
| 42 | wall |
| 50 | inlet portion |
| 55 | outlet portion |
| 60 | energy damping material |
| 70 | pores |
| 75 | material |
| 78 | depth |
| 80 | space |
| 85 | secondary wall |
| 90 | porous material |

The invention claimed is:

1. A printing system comprising:

a liquid drop ejector operable to eject liquid drops having a plurality of volumes along a first path;

a fluid passage including an energy damping structure; and a fluid flow source operable to cause the fluid to flow through the passage along the energy damping structure, wherein interaction of the fluid flow and the liquid drops causes liquid drops having one of the plurality of volumes to begin moving along a second path.

2. The system of claim 1, wherein the energy damping structure includes pores located thereon.

3. The system of claim 2, wherein the pores of the energy damping structure extend through the energy damping structure.

4. The system of claim 3, the fluid flow source operable to cause the fluid to flow through the passage being a first fluid flow source, the system further comprising:

a second fluid flow source operable to cause a portion of the fluid flowing through the passage to move through the pores of the energy damping structure.

5. The system of claim 4, wherein the second fluid flow source is a negative pressure fluid flow source.

6. The system of claim 2, wherein the pores of the energy damping structure are located on a surface of the energy damping structure.

7. The system of claim 2, wherein the pores of the energy damping structure have a random distribution of pore shape and orientation.

8. The system of claim 7, wherein the energy damping structure includes a porous material.

9. The system of claim 2, wherein the pores of the energy damping structure have a regular distribution of pore shape and orientation.

10. The system of claim 9, wherein the energy damping structure includes a mesh material.

11. The system of claim 10, wherein the energy damping structure includes a coating on the mesh material.

12. The system of claim 2, wherein the pores of the energy damping structure include a combination of pores that extend through the energy damping structure and pores that are located on a surface of the energy damping structure.

13. The system of claim 2, wherein the pores of the energy damping structure decrease in size as viewed along the direction of fluid flow through the passage.

14. The system of claim 1, wherein the energy damping structure includes an energy damping material positioned around a rigid material frame.

15. The system of claim 1, wherein the energy damping structure includes an energy damping material located on a wall of the fluid passage.

16. The system of claim 1, wherein the energy damping structure forms a wall of the fluid passage.

17. A method of printing comprising:

providing liquid drops having a plurality of volumes traveling along a first path;

providing a fluid passage including an energy damping structure; and causing a fluid to flow through the passage along the energy damping structure, wherein interaction of the fluid flow and the liquid drops causes liquid drops having one of the plurality of volumes to begin moving along a second path.

* * * * *